US007692599B2

(12) United States Patent
Wong et al.

(10) Patent No.: US 7,692,599 B2
(45) Date of Patent: Apr. 6, 2010

(54) ULTRA-WIDEBAND SHORTED DIPOLE ANTENNA

(75) Inventors: Kin-Lu Wong, Kaohsiung (TW); Wei-Yu Li, Yilan (TW); Saou-Wen Su, Taipei (TW)

(73) Assignees: National Sun Yat-Sen University, Kaohsiung (TW); Lite-On Technology Corporation, Taipei (TW)

( * ) Notice: Subject to any disclaimer, the term of this patent is extended or adjusted under 35 U.S.C. 154(b) by 0 days.

(21) Appl. No.: 12/007,919

(22) Filed: Jan. 17, 2008

(65) Prior Publication Data

US 2008/0174505 A1 Jul. 24, 2008

(30) Foreign Application Priority Data

Jan. 18, 2007 (TW) ..... 96101962 A

(51) Int. Cl.
*H01Q 9/28* (2006.01)
*H01Q 9/16* (2006.01)
*H01Q 9/04* (2006.01)

(52) U.S. Cl. ..... 343/795; 343/793; 343/700 MS

(58) Field of Classification Search ..... 343/793–823
See application file for complete search history.

(56) References Cited

U.S. PATENT DOCUMENTS 6,107,920 A * 8/2000 Eberhardt et al. ..... 340/572.7
6,624,793 B1 * 9/2003 Su et al. ..... 343/795
6,975,281 B2 12/2005 Neel
7,019,704 B2 * 3/2006 Weiss ..... 343/770
7,145,517 B1 * 12/2006 Cheng ..... 343/795
7,339,550 B2 * 3/2008 Hayama et al. ..... 343/895
7,342,553 B2 * 3/2008 Soler Castany et al. ..... 343/853
7,394,425 B2 * 7/2008 Luch ..... 343/700 MS
2004/0222936 A1 * 11/2004 Hung et al. ..... 343/795
2005/0024287 A1 * 2/2005 Jo et al. ..... 343/822
2006/0055542 A1 * 3/2006 Forster et al. ..... 340/572.7
2006/0250315 A1 * 11/2006 Parsche ..... 343/773
2008/0180342 A1 * 7/2008 Kerselaers ..... 343/795

FOREIGN PATENT DOCUMENTS

TW 574771 2/2004

* cited by examiner

*Primary Examiner*—Vibol Tan
*Assistant Examiner*—Dylan White
(74) *Attorney, Agent, or Firm*—Bacon & Thomas, PLLC

(57) ABSTRACT

An ultra-wideband shorted dipole antenna includes a coaxial cable line and first and second open-loop radiating metal plates with substantially the same shape. The coaxial cable line has a central conducting wire and an outer grounder sheath. The first and second open-loop radiating metal plates are symmetrically disposed on two sides of the antenna to form two arms of the antenna and are electrically connected to each other. Each of the first and second open-loop radiating metal plates has a signal feeding point electrically connected to the central conducting wire or the outer grounder sheath of the coaxial cable line.

10 Claims, 9 Drawing Sheets

ULTRA-WIDEBAND SHORTED DIPOLE ANTENNA

This application claims the benefit of Taiwan application Serial No. 96101962, filed Jan. 18, 2007, the subject matter of which is incorporated herein by reference.

BACKGROUND OF THE INVENTION

1. Field of the Invention

The invention relates in general to a dipole antenna, and more particularly to an ultra-wideband shorted dipole antenna that may be applied to a wireless communication band.

2. Description of the Related Art

Currently, the wireless communication frequency spectrum has been full with many application bands of the commercial wireless communication systems, such as the advanced mobile phone system (AMPS) ranging from 824 to 894 MHz, the global system for mobile communication (GSM) ranging from 880 to 960 MHz, the digital communication system (DCS) ranging from 1710 to 1880 MHz, the personal communication services (PCS) ranging from 1850 to 1990 MHz), the universal mobile telecommunication system (UMTS) ranging from 1920 to 2170 MHz and the worldwide interoperability for microwave access (WiMAX) ranging from 2500 to 2690 MHz, from 3400 to 3700 MHz and from 5250 to 5850 MHz. Thus, it is an inevitable trend to integrate various functions of commercial wireless communication application services in various traffic tools such as vehicles and buses with the better equipment. To achieve this object, the single traffic tool has to be equipped with multiple communication modules as well as multiple antenna systems. The multiple antenna systems require multiple coaxial signal cable lines, and the problems of the increased cost of manufacturing the antennas, the wasted space for accommodating the antennas and the electromagnetic interference have to be solved.

In view of the problems encountered in the multi-antenna systems, Taiwan Patent Publication No. TW574771 has disclosed a multi-meandered antenna with multiple bands and a single input to achieve the requirement of the multi-system wireless communication using the antenna having multiple resonance paths. However, the overall structure of the antenna becomes more complicated and the size thereof is significantly increased. U.S. Pat. No. 4,843,403 entitled "Broadband Notch Antenna" has disclosed a broadband antenna structure similar to the dipole antenna. However, if the notch antenna has to be configured to operate in a lower band, the size of the antenna is also too large, the antenna cannot be properly attached to the vehicle window or hidden in a vehicle bumper, and the good impedance matching cannot be achieved in the resonance band. In addition, U.S. Pat. No. 6,975,281 entitled "Reduced Size Dielectric Loaded Spiral Antenna)" discloses a conventional ultra-wideband helical antenna having the reduced size by loading a multi-layer medium. However, the helical antenna has the complicated structure, the signal feeding portion needs an additional Balun to achieve the better impedance matching. The manufacturing cost of the antenna is increased due to the required Balun and the additionally loaded multi-layer medium.

Thus, it is an important subject in the industry to satisfy the requirement in the multi-system wireless communication and to overcome the bottleneck encountered when the above-mentioned antennas are actually applied.

SUMMARY OF THE INVENTION

The invention is directed to an ultra-wideband shorted dipole antenna capable of generating an ultra-wideband impedance bandwidth ranging from 820 to 7350 MHz (the frequency ratio is about 9:1) in the wireless communication band. In addition, the dipole antenna has the simple structure, may be combined with a plane object, may be easily manufactured and has the low cost, and may be properly mounted indoors, outdoors or on a traffic vehicle to serve as a signal receiving antenna for the wireless communication band.

According to a first aspect of the present invention, an ultra-wideband shorted dipole antenna is provided. The dipole antenna includes a coaxial cable line and first and second open-loop radiating metal plates having substantially the same shape. The coaxial cable line has a central conducting wire and an outer grounder sheath. The first and second open-loop radiating metal plates are substantially disposed on two sides of the antenna symmetrically to form two arms of the antenna and electrically connected to each other. Each of the first and second open-loop radiating metal plates has a signal feeding point electrically connected to the central conducting wire or the outer grounder sheath of the coaxial cable line.

According to a second aspect of the present invention, an ultra-wideband shorted dipole antenna is provided. The dipole antenna includes a medium substrate, two radiating metal plates, at least one conductor element and a coaxial cable line. The two radiating metal plates have substantially the same shape. Each of the radiating metal plates has a signal feeding point and an opening. The radiating metal plates are symmetrically disposed on the medium substrate so that the two openings have opposite outward directions and the two signal feeding points are disposed between the openings. The conductor element is electrically connected to and between the two radiating metal plates. The coaxial cable line couples the two signal feeding points together.

According to the experimental result of the invention, the antenna of the invention can generate an ultra-wideband impedance bandwidth with a frequency ratio of about 9:1 in the wireless communication band, and the antenna radiation pattern and the antenna gain can satisfy the actual application of receiving the wireless communication band signal. In this invention, two simple open-loop radiating metal plates constitute two arms of the dipole antenna so that the resonance current path of the antenna can be lengthened and the size of the antenna can be reduced. In addition, one short-circuiting thin metal plate or a plurality of simple short-circuiting thin metal plates is electrically connected to the dipole antenna constituted by the two simple open-loop radiating metal plates in order to adjust the impedance matching of the antenna. Thus, the antenna of the invention can achieve the ultra-wideband impedance bandwidth in the wireless communication band. In practice, the coaxial cable line can be placed in a region without a metal plate and surrounded by the two open-loop radiating metal plates and an opening thereof so as to prevent the coaxial cable line from influencing the radiation property of the antenna. Because the antenna of the invention has the simple structure, can be combined with a plane object, can be easily manufactured and has the low cost, the antenna can be properly mounted indoors, outdoors or on the traffic tool to serve as the signal receiving antenna for the wireless communication band.

The invention will become apparent from the following detailed description of the preferred but non-limiting embodiments. The following description is made with reference to the accompanying drawings.

DETAILED DESCRIPTION OF THE INVENTION

First Embodiment

Figure 1:
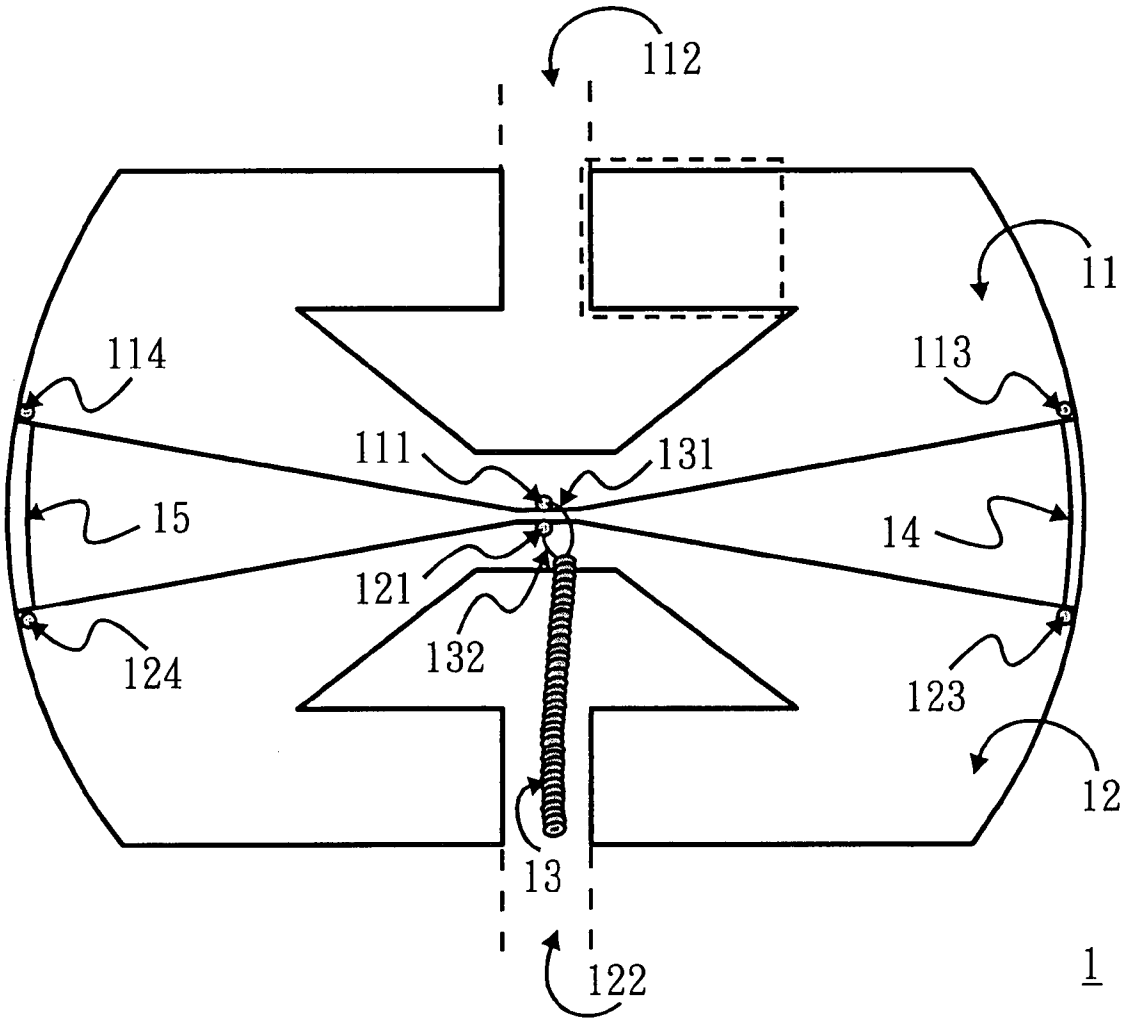
FIG. 1 is a structural diagram showing an ultra-wideband shorted dipole antenna according to a first embodiment of the invention.

FIG. 1 is a structural diagram showing an ultra-wideband shorted dipole antenna 1 according to a first embodiment of the invention. Referring to FIG. 1, the ultra-wideband shorted dipole antenna 1 includes a coaxial cable line 13 and first and second open-loop radiating metal plates 11 and 12 having substantially the same shape. The coaxial cable line 13 has a central conducting wire 131 and an outer grounder sheath 132. The first and second open-loop radiating metal plates 11 and 12 respectively have signal feeding points 111 and 121 and openings 112 and 122 and are substantially disposed on two sides of the ultra-wideband shorted dipole antenna 1 symmetrically to form two arms of the ultra-wideband shorted dipole antenna 1.

As shown in FIG. 1, the first and second open-loop radiating metal plates 11 and 12 are disposed symmetrically so that the two openings 112 and 122 have opposite outward directions and the signal feeding points 111 and 121 are disposed adjacent to each other and between the openings 112 and 122. The central conducting wire 131 and the outer grounder sheath 132 of the coaxial cable line 13 are respectively coupled to the signal feeding points 111 and 121. In addition, two short-circuiting thin metal plates 14 and 15 serve as conductor elements to be electrically connected to the two open-loop radiating metal plates 11 and 12 in this embodiment. The material of the short-circuiting thin metal plates 14 and 15 may be different from that of the radiating metal plates, or the short-circuiting thin metal plates 14 and 15 and the radiating metal plates may be formed in one piece as a whole by cutting a metal plate. In FIG. 1, the two short-circuiting thin metal plates 14 and 15 are respectively disposed on two sides of the signal feeding points 111 and 121. For example, the short-circuiting thin metal plate 14 is electrically connected to a short-circuited point 113 of the first open-loop radiating metal plate 11 and a short-circuited point 123 of the second open-loop radiating metal plate 12. The short-circuiting thin metal plate 15 is electrically connected to a short-circuited point 114 of the first open-loop radiating metal plate 11 and a short-circuited point 124 of the second open-loop radiating metal plate 12. Thus, the inductance of the antenna can be increased so that the capacitor effects between neighboring edges of the first and second open-loop radiating metal plates 11 and 12 may be offset and the impedance matching of the ultra-wideband shorted dipole antenna 1 can be adjusted. Thus, the ultra-wideband shorted dipole antenna 1 can achieve an ultra-wideband impedance bandwidth.

The design of the openings 112 and 122 can lengthen the resonance current path of the antenna on the first and second open-loop radiating metal plates 11 and 12 and thus reduce the size of the antenna. Furthermore, the coaxial cable line 13 being actually used may also be disposed in the opening 112 or 122 (in the opening 122 in FIG. 1), or in the region without the metal plate in the ultra-wideband shorted dipole antenna 1 in order to prevent the coaxial cable line 13 from influencing the radiation property of the antenna. The dimension and the property of the ultra-wideband shorted dipole antenna 1 of this embodiment will be described in the following.

Figure 2:
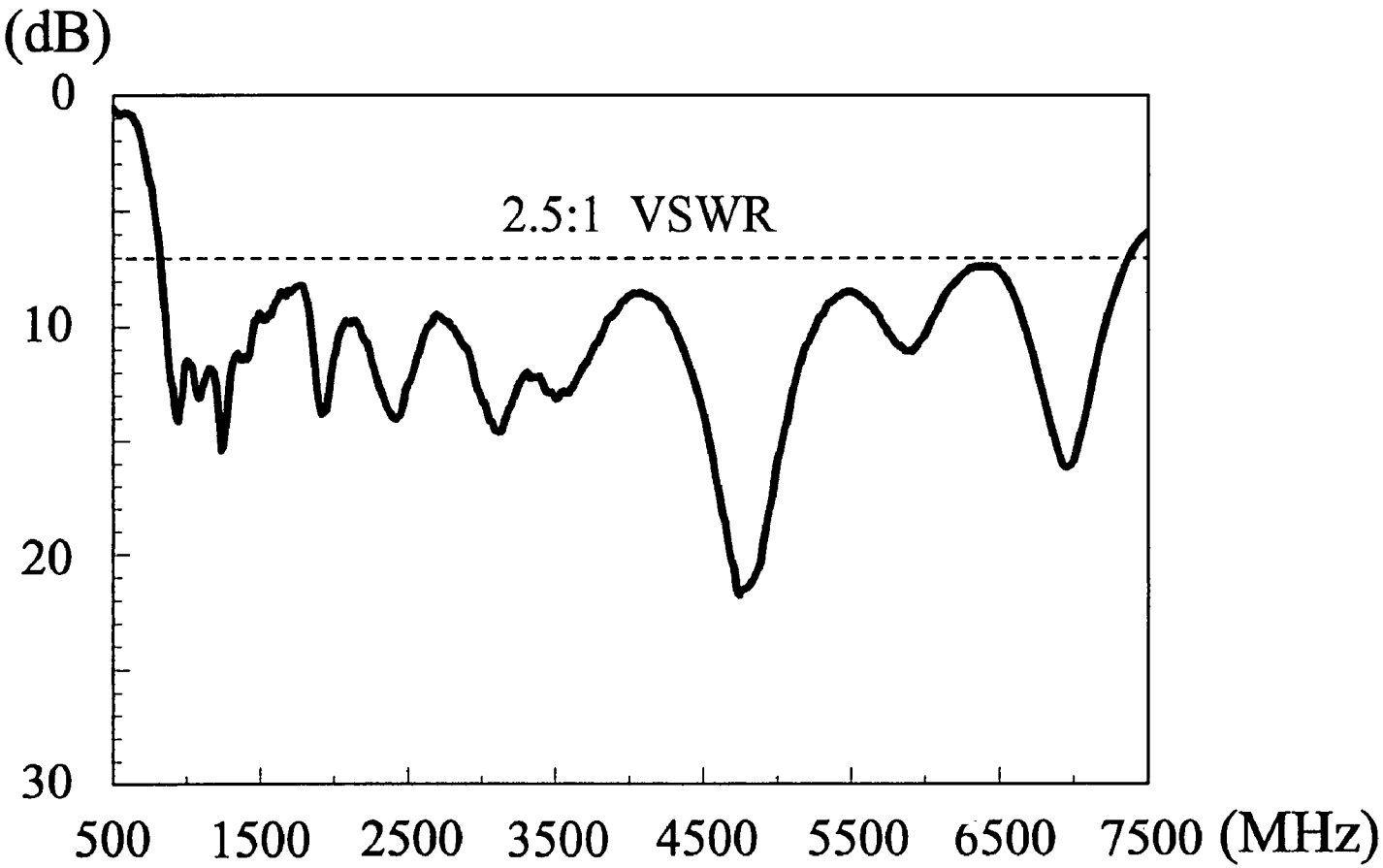
FIG. 2 is a measurement graph showing the return loss in the ultra-wideband shorted dipole antenna 1 according to the first embodiment of the invention.

FIG. 2 is a measurement graph showing the return loss in the ultra-wideband shorted dipole antenna 1 according to the first embodiment of the invention. The experimental measurement will be made by taking the following dimensions as an example in this embodiment.

The ultra-wideband shorted dipole antenna 1 has a total width (e.g., the gap between the short-circuiting thin metal plates 14 and 15 in FIG. 1), which is about 170 mm, and a total length, which is about 109 mm. The total path length from the signal feeding point 111 (121) to the opening 112 (122) along either side of the first (second) open-loop radiating metal plate 11 (12) is about 125 mm, and the gap between the signal feeding points 111 and 121 is about 2 mm. Each of the short-circuiting thin metal plates 14 and 15 has a length of about 30 mm, and a width of about 2 mm. The short-circuiting thin metal plates 14 and 15 may be symmetrically disposed on a left side and a right side of the signal feeding points 111 and 121, for example. The short-circuited points 113 and 123 at the right side and the short-circuited points 114 and 124 at the left side are distant from the signal feeding points 111 and 121 by about 85 mm.

In addition, a gradually widened structure having a gradually changed width ranging from 10 to 35 mm exists between the signal feeding points 111 and 121 and the short-circuited points 113 and 123 at the right side (or the short-circuited points 114 and 124 at the left side). A constant-width structure, as illustrated by a dashed-line frame range of FIG. 1, having a constant width of 20 mm exists between the turning portion of the opening and the opening 112 (122) in each of the right and left sides of the first (second) open-loop radiating metal plate 11 (12).

In FIG. 2, the vertical axis represents the return loss value of the antenna, and the horizontal axis represents the operation frequency of the antenna. It is observed, from the measurement result of the return loss, that the operation band of the ultra-wideband shorted dipole antenna 1 with the above-mentioned design can cover the ultra-wideband bandwidth (the frequency ratio is about 9:1) from 820 to 7350 MHz and the return loss level thereof can satisfy the actual application requirement of receiving the mobile communication signal under the return loss definition (about 7.35 dB) of the voltage standing wave ratio (VSWR) of 2.5:1.

Figure 3:
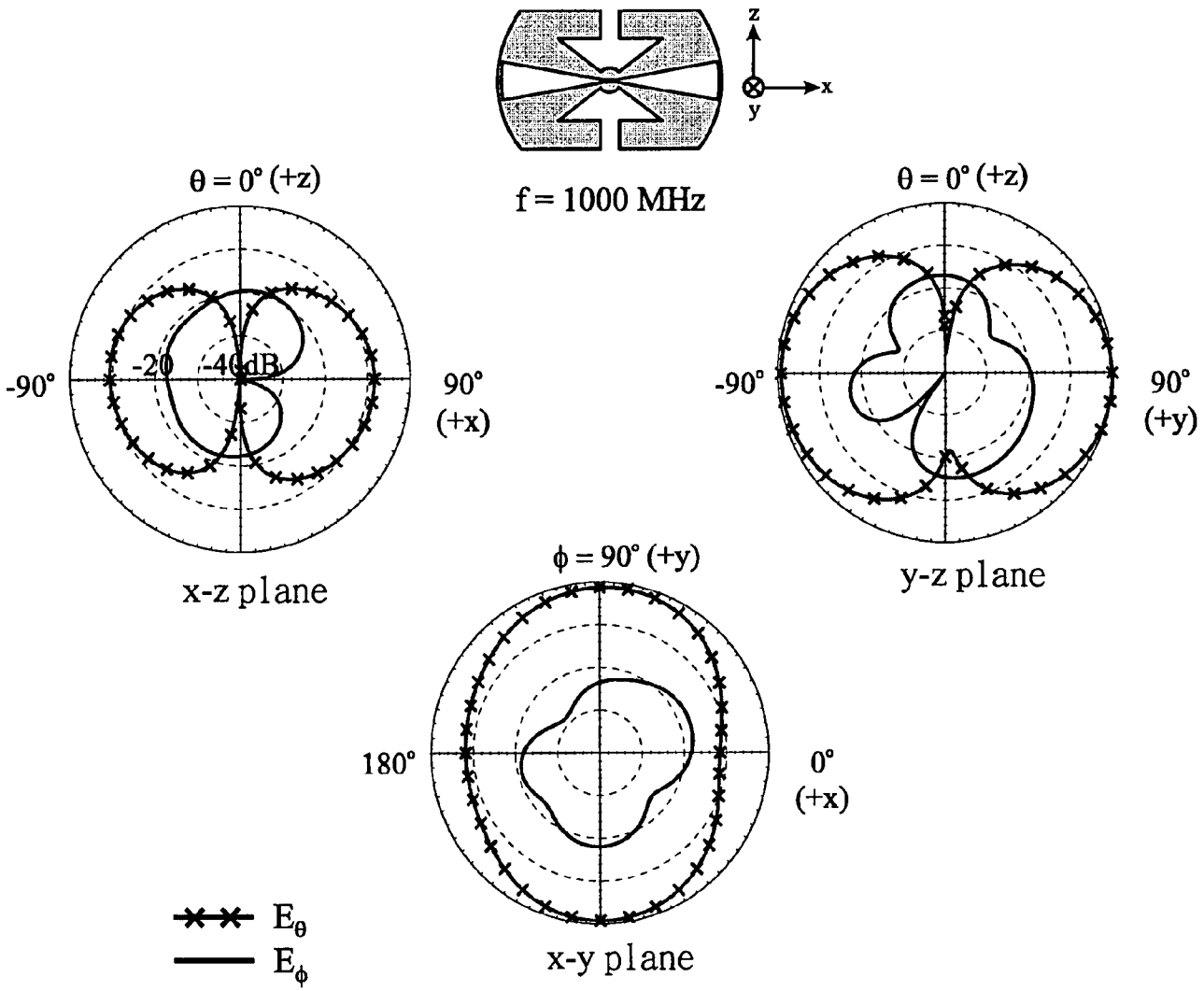
FIGS. 3 to 5 show radiation patterns of the ultra-wideband shorted dipole antenna 1 of the first embodiment at 1000 MHz, 4000 MHz and 6000 MHz.
Figure 4:
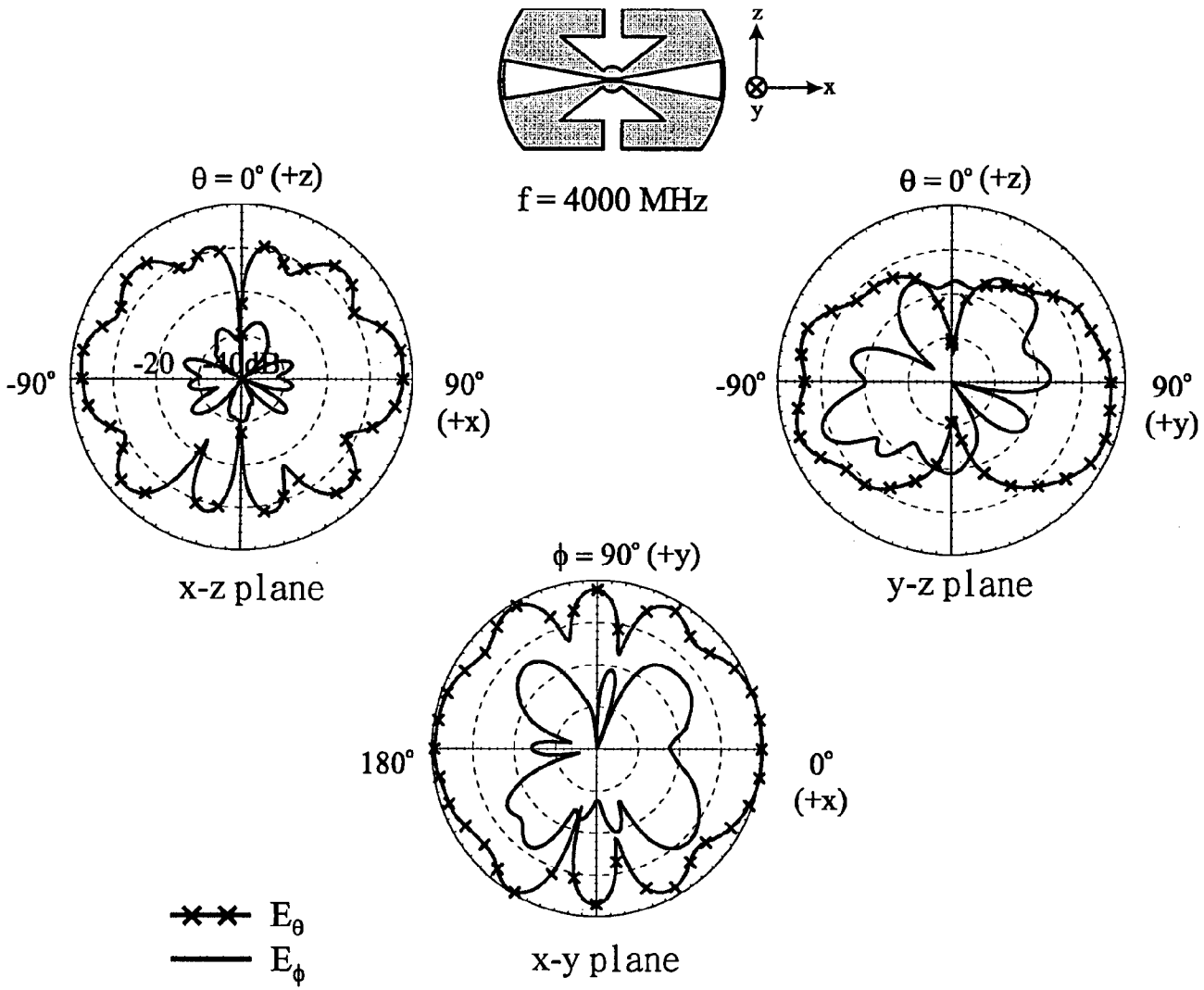
Figure 5:
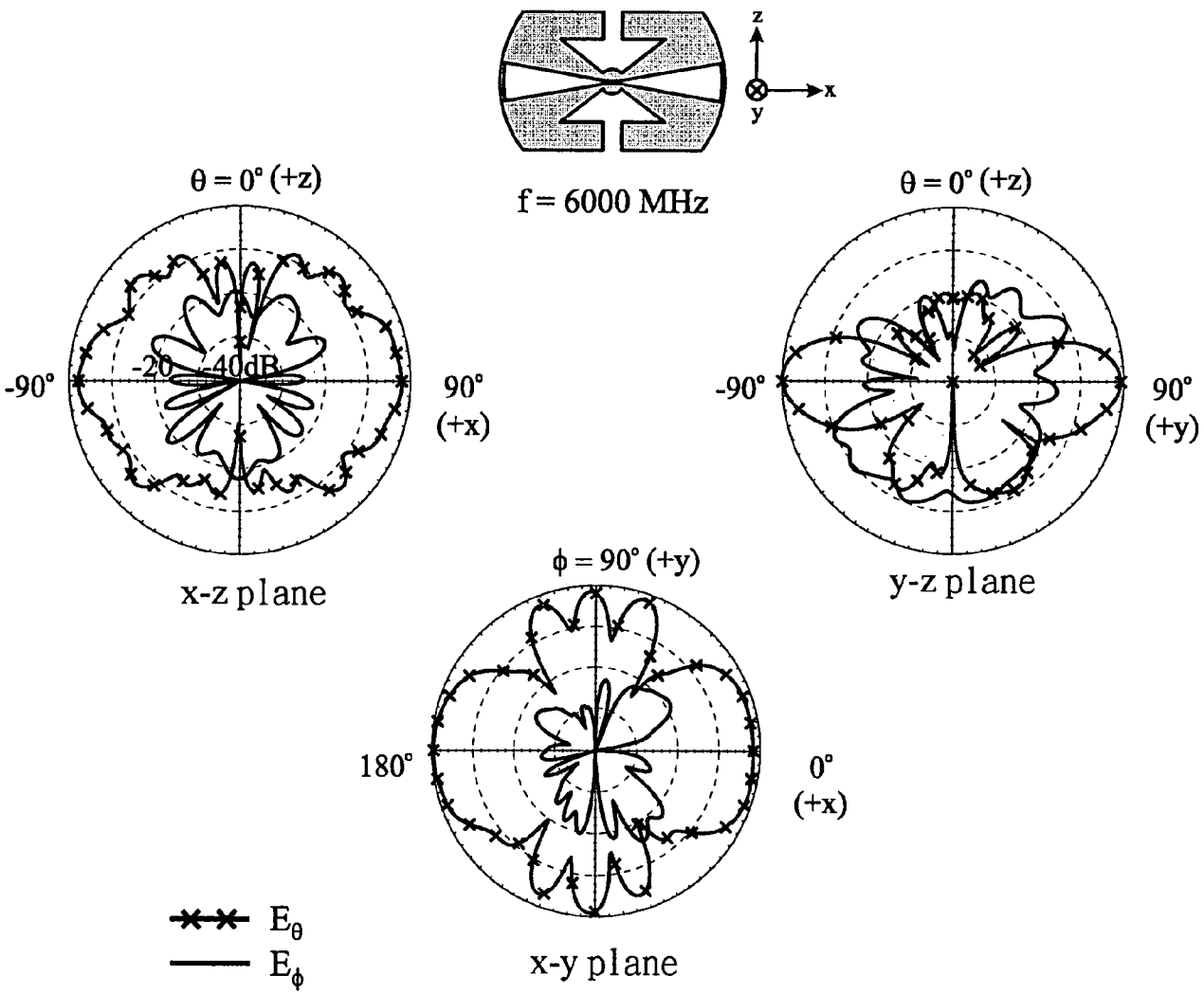

FIGS. 3 to 5 show radiation patterns of the ultra-wideband shorted dipole antenna 1 of the first embodiment at 1000

MHz, 4000 MHz and 6000 MHz. As shown in FIGS. 3 to 5, the ultra-wideband shorted dipole antenna 1 can satisfy the requirement in the actual application pattern for receiving the mobile communication signal, and the property of the gradually increasing number of sidelobes of the radiation pattern with the increase of the operation frequency is the same as that of the conventional dipole antenna.

Figure 6:
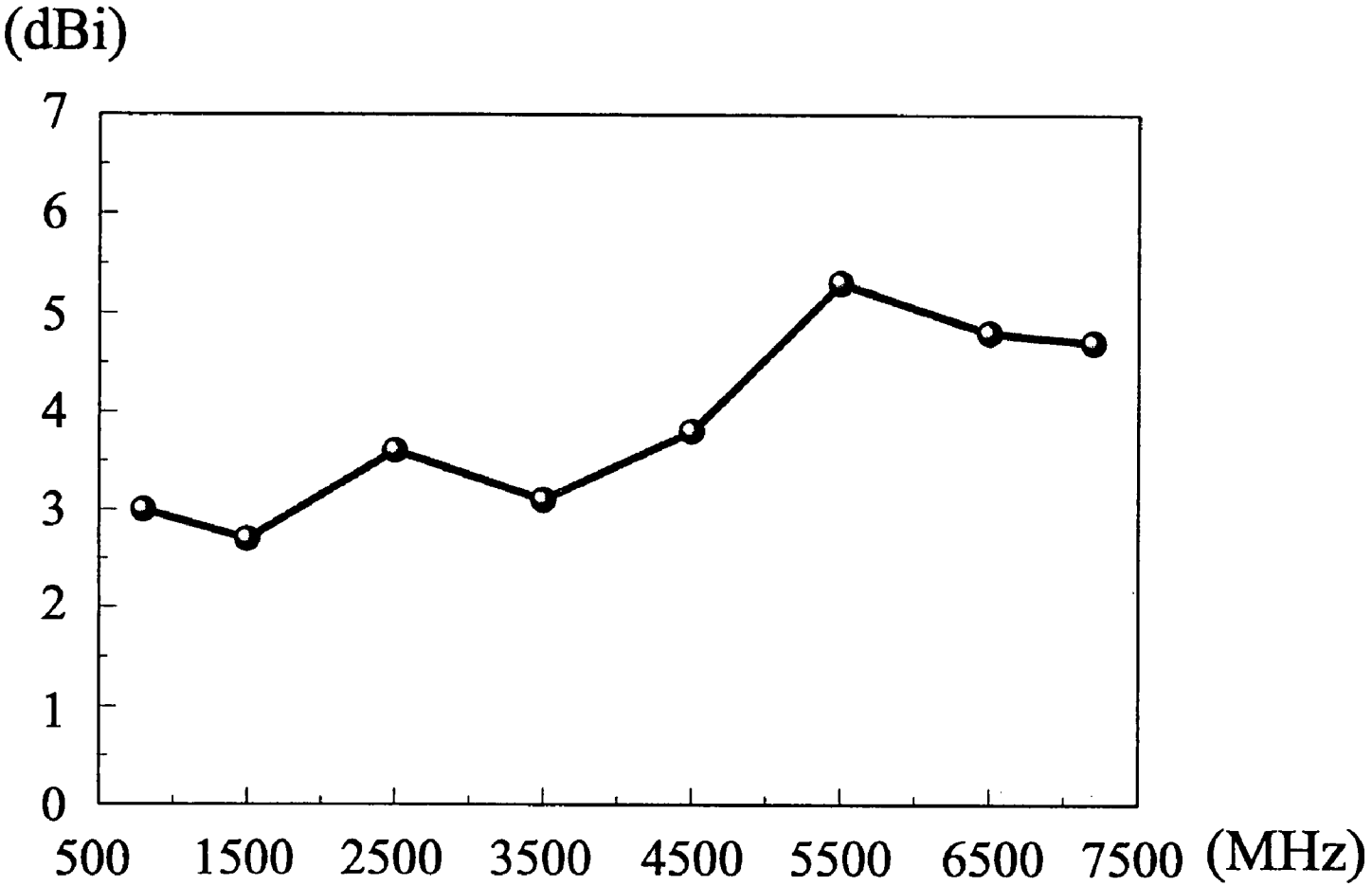
FIG. 6 is a graph showing an antenna gain of the ultra-wideband shorted dipole antenna 1 of the first embodiment within its operation band.

FIG. 6 is a graph showing an antenna gain of the ultra-wideband shorted dipole antenna 1 of the first embodiment within its operation band. In FIG. 6, the vertical axis represents the antenna gain, and the horizontal axis represents the operation frequency of the antenna. As shown in FIG. 6, the antenna gain between 500 and 7500 MHz ranges from about 2.5 to 5.5 dBi, and satisfies the requirement in the actual application gain for receiving the mobile communication signal.

Second Embodiment

Figure 7:
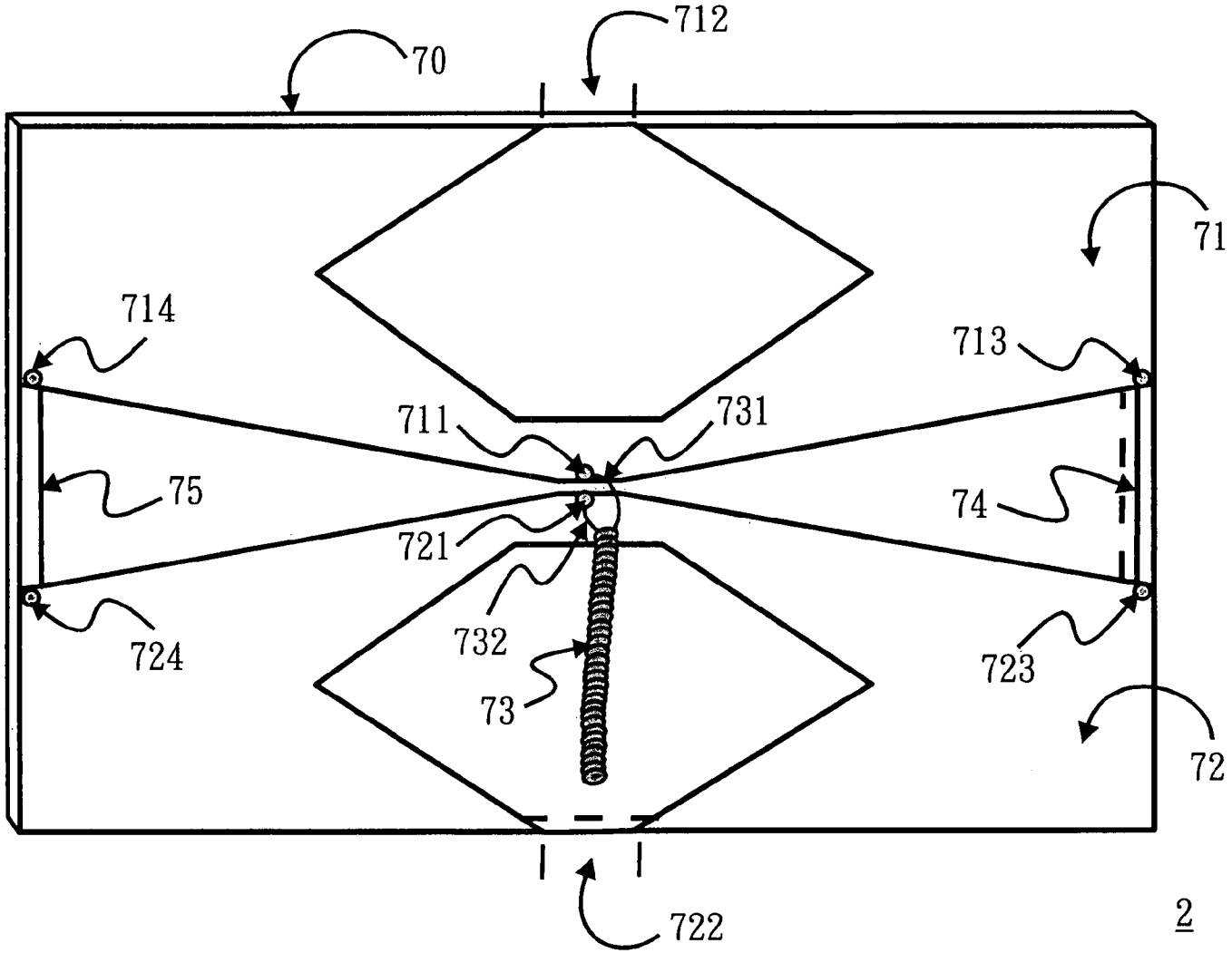
FIG. 7 is a structural diagram showing an ultra-wideband shorted dipole antenna according to a second embodiment of the invention.

FIG. 7 is a structural diagram showing an ultra-wideband shorted dipole antenna according to a second embodiment of the invention. As shown in FIG. 7, what is different from the first embodiment is that first and second open-loop radiating metal plates 71 and 72 of the ultra-wideband shorted dipole antenna 2 in the second embodiment are formed on a medium substrate 70 by way of etching or printing. In addition, the external shapes of the open-loop radiating metal plates 71 and 72 and the shapes of the inner edges of openings 712 and 722 are adjusted according to the consideration of the manufacturing and the actual application, wherein the overall antenna has a rectangular shape different from the arced shapes on two sides of the antenna of the first embodiment. The resonance current path of the antenna can be lengthened and the size of the antenna can be reduced according to the configuration of the openings 712 and 722 and short-circuiting thin metal plates 74 and 75. In addition, the inductance of the antenna can be increased in order to offset the capacitor effects between the neighboring edges of the two open-loop radiating metal plates 71 and 72 and thus to adjust the impedance matching of the antenna. Thus, the ultra-wideband shorted dipole antenna 2 may also have the impedance bandwidth and the radiation property similar to those of the first embodiment. The coaxial cable line 73 has a central conducting wire 731 and an outer grounder sheath 732. The central conducting wire 731 and the outer grounder sheath 732 of the coaxial cable line 73 are respectively coupled to the signal feeding points 711 and 721. Furthermore, the coaxial cable line 73 being actually used may also be disposed in the opening 712 or 722 (in the opening 722 in FIG. 7), or in the region without the metal plate in the ultra-wideband shorted dipole antenna 2 in order to prevent the coaxial cable line 73 from influencing the radiation property of the antenna.

Third Embodiment

Figure 8:
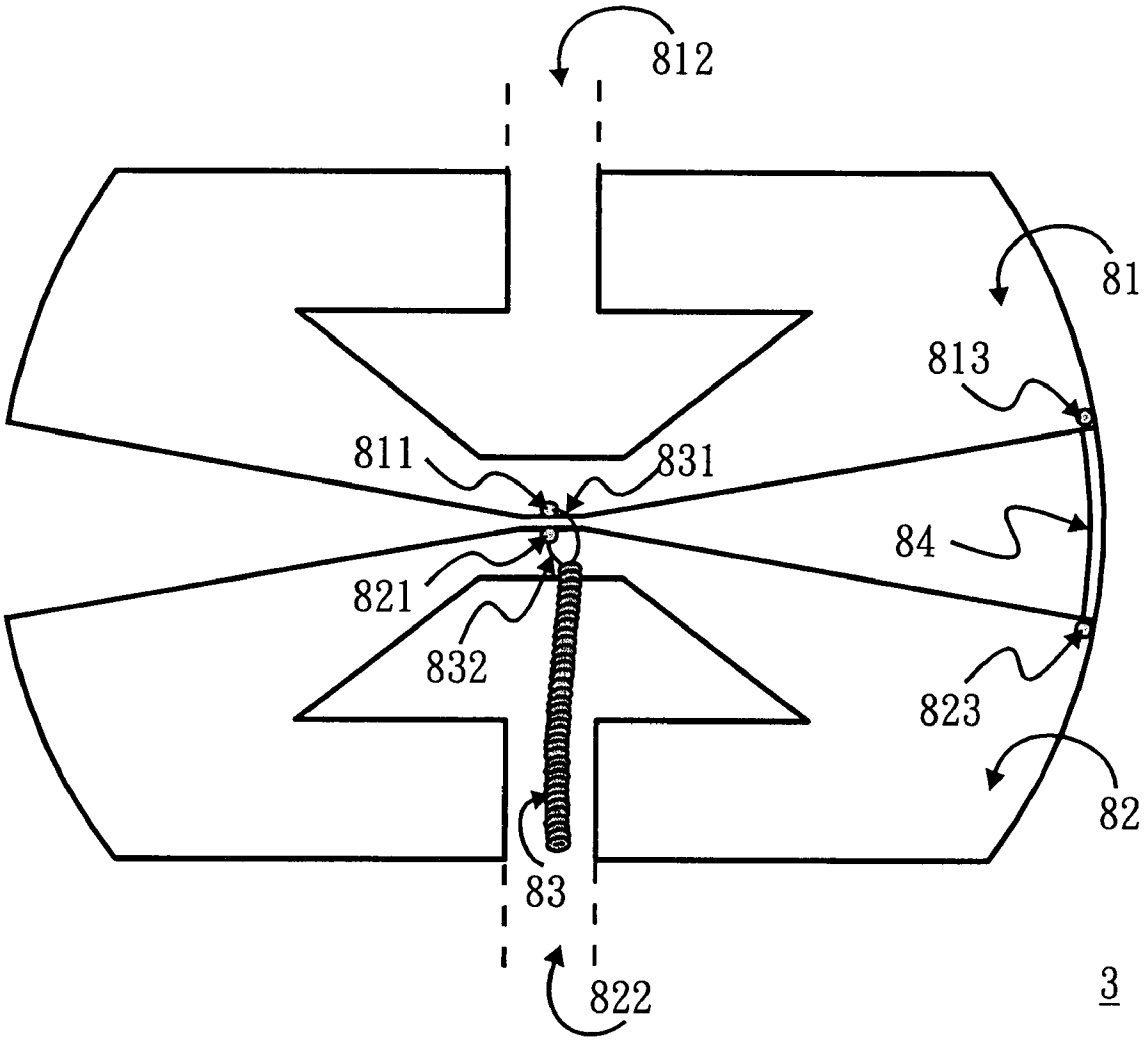
FIG. 8 is a structural diagram showing an ultra-wideband shorted dipole antenna according to a third embodiment of the invention.

FIG. 8 is a structural diagram showing an ultra-wideband shorted dipole antenna according to a third embodiment of the invention. The ultra-wideband shorted dipole antenna 3 includes a coaxial cable line 83 and first and second open-loop radiating metal plates 81 and 82 having substantially the same shape. The coaxial cable line 83 has a central conducting wire 831 and an outer grounder sheath 832. The first and second open-loop radiating metal plates 81 and 82 respectively have signal feeding points 811 and 821 and openings 812 and 822 and are substantially disposed on two sides of the ultra-wideband shorted dipole antenna 3 symmetrically to form two arms of the ultra-wideband shorted dipole antenna 3. Compared with FIG. 1, the ultra-wideband shorted dipole antenna 3 only has one single short-circuiting thin metal plate 84, which is electrically connected to a short-circuited point 813 of the first open-loop radiating metal plate 81 and a short-circuited point 823 of the second open-loop radiating metal plate 82, for adjusting the impedance matching of the antenna, and the other structures are the same as those of the first embodiment. Thus, the ultra-wideband shorted dipole antenna 3 may also have the impedance bandwidth and the radiation property similar to those of the first embodiment.

Figure 9:
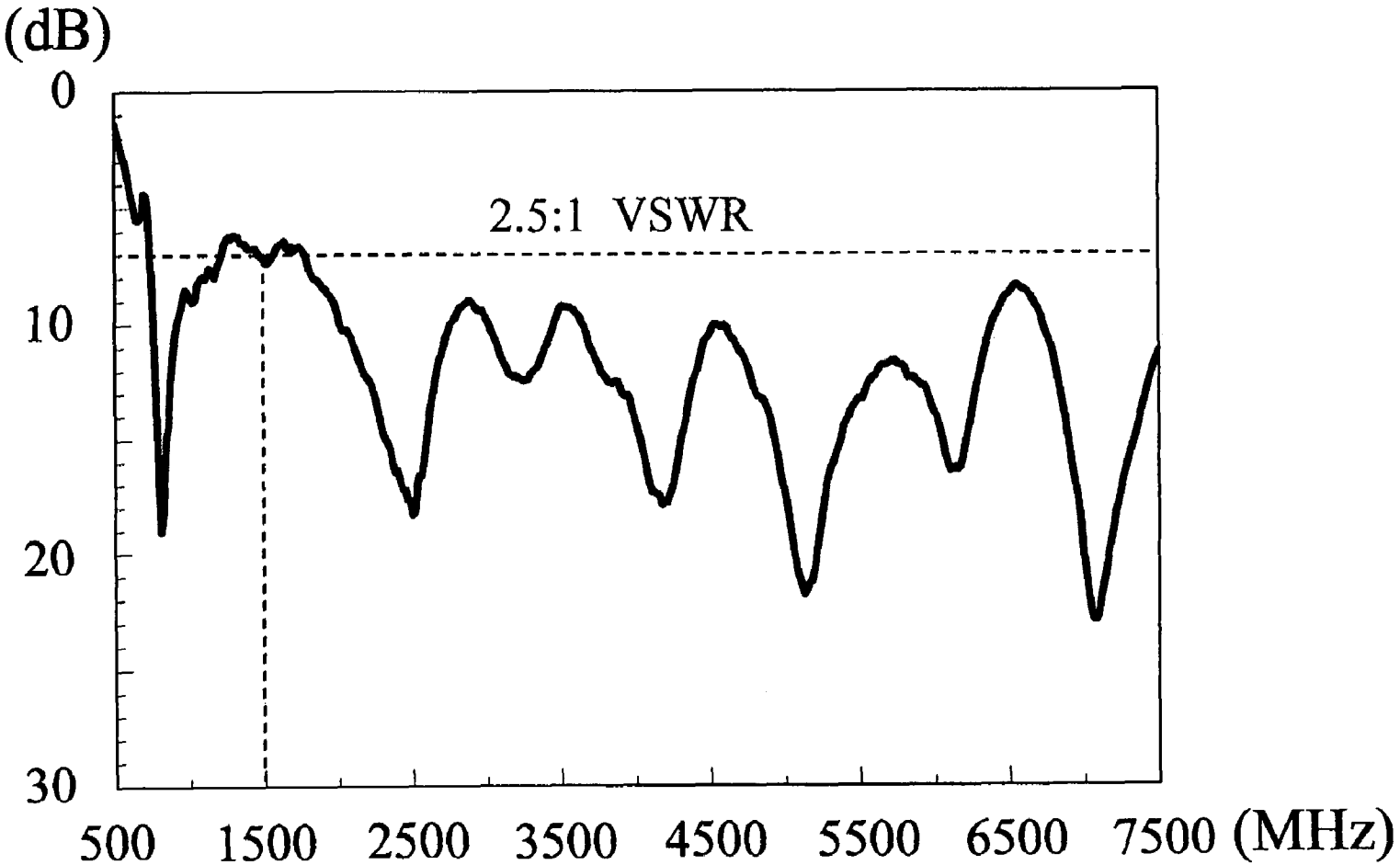
FIG. 9 is a measurement graph showing the return loss in the ultra-wideband shorted dipole antenna 3 according to the third embodiment of the invention.

FIG. 9 is a measurement graph showing the return loss in the ultra-wideband shorted dipole antenna 3 according to the third embodiment of the invention. In FIG. 9, the vertical axis represents the return loss value of the antenna and the horizontal axis represents the operation frequency of the antenna. It is observed, from the measurement result of the return loss, that the ultra-wideband shorted dipole antenna 3 has the return loss value capable of satisfying the return loss standard under the VSWR of 2.5:1 in the band zone from about 800 to 7500 MHz except that the return loss value around 1.5 GHz is slightly higher than the return loss standard under the VSWR of 2.5:1. So, the dipole antenna 3 can also satisfy the actual application requirement of receiving the mobile communication signal.

In summary, the ultra-wideband shorted dipole antenna of the invention uses two simple open-loop radiating metal plates to constitute two arms of the dipole antenna so that the resonance current path of the antenna can be lengthened and the size of the antenna can be reduced. In practice, the coaxial cable line can be placed in a region without the metal plate and surrounded by the two open-loop radiating metal plates and an opening thereof so as to prevent the coaxial cable line from influencing the radiation property of the antenna. In addition, the ultra-wideband shorted dipole antenna of the invention further has one short-circuiting thin metal plate or a plurality of simple short-circuiting thin metal plates to be electrically connected to the two open-loop radiating metal plates. Thus, the impedance matching of the antenna can be adjusted and the ultra-wideband shorted dipole antenna can generate the ultra-wideband impedance bandwidth having the frequency ratio greater than 9:1 in the wireless communication band. Of course, one of ordinary skill in the art may easily understand that the number of the short-circuiting thin metal plates and the connecting positions can be properly modified to obtain the required impedance matching. Alternatively, the gradually widened structure defined by the neighboring edges (or the angle between the neighboring edges) in the open-loop radiating metal plates 11 and 12 of the FIG. 1 may also be modified to adjust the impedance matching of the antenna. Changing the length of the structure having the constant width can further adjust the lowest resonance frequency of the antenna and thus achieve the object of reducing the size. Consequently, the ultra-wideband shorted dipole antenna of the invention has the simple structure, can be combined with the plane object, can be hidden and thus save the space, and can be easily manufactured with the low cost. So, the ultra-wideband shorted dipole antenna can be properly mounted indoors, outdoors or on the traffic vehicle to serve as the signal receiving antenna of the wireless communication band and have the definite function. Thus, the antenna of the invention has the high value in the industrial application and satisfies the scope of the invention.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An ultra-wideband shorted dipole antenna, comprising:

a coaxial cable line having a central conducting wire and an outer grounder sheath; and a first open-loop radiating metal plate and a second open-loop radiating metal plate, both of which have substantially the same shape, substantially disposed on two sides of the antenna symmetrically to form two arms of the antenna and short-circuited to each other, wherein each of the first open-loop radiating metal plate and the second open-loop radiating metal plate has a signal feeding point electrically connected to the central conducting wire or the outer grounder sheath of the coaxial cable line, wherein, the first open-loop radiating metal plate and the second open-loop radiating metal plate are electrically connected to each other through a plurality of short-circuiting thin metal plates.

2. The antenna according to claim 1, wherein the first open-loop radiating metal plate and the second open-loop radiating metal plate are electrically connected to each other through a short-circuiting thin metal plate.

3. The antenna according to claim 1, wherein the first open-loop radiating metal plate and the second open-loop radiating metal plate are formed by cutting a metal plate.

4. The antenna according to claim 1, wherein the first open-loop radiating metal plate and the second open-loop radiating metal plate are formed on a medium substrate by way of etching or printing.

5. An ultra-wideband shorted dipole antenna, comprising:

a medium substrate;

two radiating metal plates, which have substantially the same shape, wherein each of the radiating metal plates has a signal feeding point and an opening, and the radiating metal plates are symmetrically disposed on the medium substrate so that the two openings have opposite outward directions and the two signal feeding points are disposed adjacent to each other and between the openings; and at least one conductor element, via which the two radiating metal plates are short-circuited, wherein, the two radiating metal plates are electrically connected to each other through a plurality of short-circuiting thin metal plates.

6. The antenna according to claim 5, further comprising a plurality of the conductor elements respectively disposed on two sides of the two signal feeding points.

7. The antenna according to claim 5, wherein the two radiating metal plates are formed on the medium substrate by way of etching or printing.

8. The antenna according to claim 5, wherein the conductor element and the two radiating metal plates are formed in one piece as a whole.

9. The antenna according to claim 5, wherein a coaxial cable line is used for coupling the two signal feeding points together, and the coaxial cable line is disposed in one of the two openings.

10. An ultra-wideband shorted dipole antenna, comprising:

a first open-loop radiating metal plate and a second open-loop radiating metal plate, both of which have substantially the same shape, substantially disposed on two sides of the antenna symmetrically to form two arms of the antenna and short-circuited to each other, wherein each of the first open-loop radiating metal plate and the second open-loop radiating metal plate has a signal feeding point electrically connected to a central conducting wire or a outer grounder sheath of a coaxial cable line, wherein, the first open-loop radiating metal plate and the second open-loop radiating metal plate are electrically connected to each other through a plurality of short-circuiting thin metal plates.

* * * * *